US005803481A

United States Patent [19]

Eaton et al.

[11] Patent Number: 5,803,481

[45] Date of Patent: Sep. 8, 1998

[54] FOOT MOUNTS FOR SNOWBOARDS

[76] Inventors: Eric L. Eaton, 6646 S. Prospect, Tacoma, Wash. 98409; John C. Bitow, 4815 51st St. Court Test, Tacoma, Wash. 98443

[21] Appl. No.: 609,287

[22] Filed: Mar. 1, 1996

[51] Int. Cl.[6] ..... A63C 7/10

[52] U.S. Cl. ..... 280/633; 280/14.2; 280/620

[58] Field of Search ..... 280/607, 618, 280/14.2, 633, 620

[56] References Cited

U.S. PATENT DOCUMENTS

| | | | |
|---|---|---|---|
| 4,728,116 | 3/1988 | Hill | 280/618 |
| 5,035,443 | 7/1991 | Kincheloe | 280/618 |
| 5,044,654 | 9/1991 | Meyer | 280/613 |
| 5,054,807 | 10/1991 | Fauvet | 280/607 |
| 5,261,689 | 11/1993 | Carpenter et al. | 280/14.2 |
| 5,354,088 | 10/1994 | Vetter et al. | 280/618 |
| 5,553,883 | 9/1996 | Erb | 280/618 |
| 5,577,755 | 11/1996 | Metzger et al. | 280/607 |

FOREIGN PATENT DOCUMENTS

| | | | |
|---|---|---|---|
| 602341 | 6/1994 | Germany | 280/14.2 |

*Primary Examiner*—Brian L. Johnson
*Assistant Examiner*—Jonathan E. Butts
*Attorney, Agent, or Firm*—Delbert J. Barnard; David P. Campbell

[57] ABSTRACT

A snowboard (10) is provided with front and rear foot mounts (12, 14). The front foot mount (12) is mounted for rotation or pivotable movement about an axis (22). It is lockable into a number of rider selected azimuthal positions on the snowboard (10). Foot rotation can be used to move it between some positions. In other positions, the front foot mount (12) is locked in position and cannot be moved to a new position without the rider first pulling on a pull line (112), to unlock the front foot mount (12) from the snowboard (10). The rear foot mount (14) is a step-in step-out mount. The rider can step in at a number of different azimuthal positions, selected by the rider. In each position, the rear foot mount (14) is moved by rotation into a position where it is locked to the snowboard (10). A pull line (160) is used to unlock the rear mount (114) front of the board, so that the rider can rotate his/her rear foot into a step-out position.

23 Claims, 6 Drawing Sheets

FOOT MOUNTS FOR SNOWBOARDS

TECHNICAL FIELD

This invention relates to snowboards. More particularly, it relates to the provision of snowboards having front foot mounts which allow the rider to rotate or pivot his/her front foot in position on the snowboard, and to such snowboards which are also provided with a step-out type rear foot mount.

BACKGROUND OF THE INVENTION

U.S. Pat. No. 5,354,088, granted Oct. 11, 1994, to Dennis A. Veter and Eric L. Eaton discusses snowboards, their use on ski slopes, the need for the snowboard rider to have one leg free for use to push himself/herself forward on the snowboard, and problems encountered when mounting and dismounting a chair on a chair lift. The invention of U.S. Pat. No. 5,354,088 provides a step-out rear foot mount for a snowboard. The present invention provides a front foot mount for a snowboard which permits the rider to rotate or pivot his/her foot in position on the board. The invention also provides such front foot mount in combination with a step-out rear foot mount.

U.S. Pat. No. 4,728,116, granted Mar. 1, 1988 to Kurt J. Hill, U.S. Pat. No. 5,035,443, granted Jul. 30, 1991 to Chris Lee Kincheloe, U.S. Pat. No. 5,044,654, granted Sep. 3, 1991 to Urs Meyer, U.S. Pat. No. 5,054,807, granted Oct. 8, 1991 to Jean-Francios Fauvet, and the aforementioned U.S. Pat. No. 5,354,088 should all be carefully considered for the purpose of putting the present invention into proper perspective relative to the prior art.

SUMMARY OF THE INVENTION

The present invention is basically characterized by a snowboard having a front foot component to which in use the front foot of the snowboard rider is secured. The front foot component is secured to a front foot station on the snowboard, for rotation or pivotable movement about an axis, in response to a rotation or pivotable movement by the rider of his/her front foot and the front foot component, relative to the snowboard. A releasable lock is provided for locking the front foot component into a plurality of rider-selected positions on the snowboard.

In preferred form, the lock includes a plurality of catches at the front foot station, spaced about the axis. The snowboard includes a lock pin carried by the front foot component that is selectively engageable in said catches, for locking the front foot component in a rider-selected position on the snowboard. In preferred form, the lock pin is spring biased towards the snowboard, towards and into each catch, as said pin moves into registry with the catch in response to rotation by the rider of his/her front foot and the front foot component in position on the snowboard.

In the preferred forms, at least one of the catches engages a short end portion of the spring biased lock pin, so that the lock pin functions as a detent and is moveable into and out from such catch by rider rotation of his/her front foot and the front foot component in position on the snowboard. In preferred form, at least one of the catches is sized to receive a longer end portion of the lock pin and hold it in a catch until the lock pin is withdrawn from the catch by the rider. For this purpose, the lock pin is provided with a pull line that in use is secured to the lock pin and extends upwardly into a position to be grasped by the rider. The pull line is pulled upon by the rider to pull the lock pin out of engagement with the catch.

In the preferred embodiment, the lock includes a plurality of first catches at the front foot station, spaced about the axis. It also includes a plurality of second catches at the front foot station, also spaced about the axis. The lock pin carried by the front foot component is selectively engageable with the first and second catches, for locking the front foot component in a rider selected position on the snowboard. The lock pin is spring biased towards the snowboard, towards and into engagement with a said catch as the lock pin moves into registry with the catch, in response to rotation by the rider of his/her front foot and the front foot component in position on the snowboard. The first catches engage a short end portion of the spring biased lock pin, so that the lock pin functions as a detent that is movable into and out from each said first catch by rider rotation of his/her front foot and front foot component. The second catches are sized to receive a longer end portion of the rock pin and hold it against sideways movement until it is withdrawn from the catch by the rider. The lock pin includes a pull line that in use is secured to the lock pin and extends upwardly into a position to be grasped by the rider. The pull line is pulled upon by the rider to pull the lock pin out of engagement with a said second catch.

According to another aspect of the invention, the snowboard is provided with both a rotatable or pivotal front foot mount, of the character described, and a step-out rear foot mount, e.g. such as disclosed by U.S. Pat. No. 5,354,088. This combination of mounts provides for maximum convenience to the rider, both when riding the snowboard on a slope and when mounting, riding and dismounting a chair of a chair lift.

Other more detailed features of the invention are described in the description of the preferred embodiment and are particularly pointed out in the appended claims.

BRIEF DESCRIPTION OF THE DRAWINGS

Like reference numerals are used to designate like parts throughout the several views of the drawing, and.

BEST MODE FOR CARRYING OUT THE INVENTION

Figure 1:
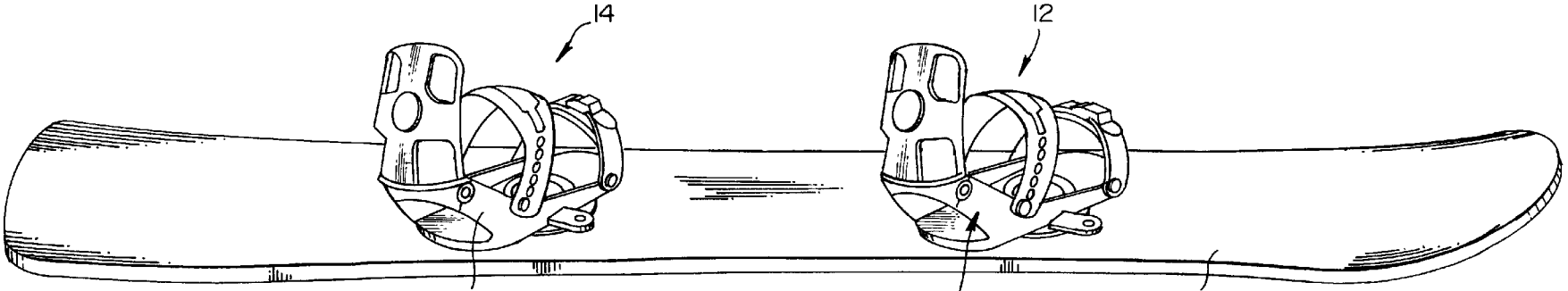
FIG. 1 is a pictorial view taken from above and looking down towards the top and one side of a snowboard, such view showing two boot receiving bindings spaced longitudinally apart on the snowboard, one for receiving a boot on the front foot of a rider and the other for receiving a boot on the rear foot of the rider such bindings representing preferred embodiments of front and rear foot mounts.

FIG. 1 shows a snowboard 10 to which a front foot component 12 and a rear foot component 14 are attached. The front foot component is shown in the form of a binding 14 that is adapted to receive a boot on the front foot of the snowboard rider. In like fashion, the rear foot component 14 is shown in the form of a similar binding 16 that is adapted to receive a boot on the rear foot of the snowboard rider. However, it is within the scope of the invention for the two foot mounts 12, 14 to be in the form of specially constructed boots worn by the snowboard rider.

Figure 2:
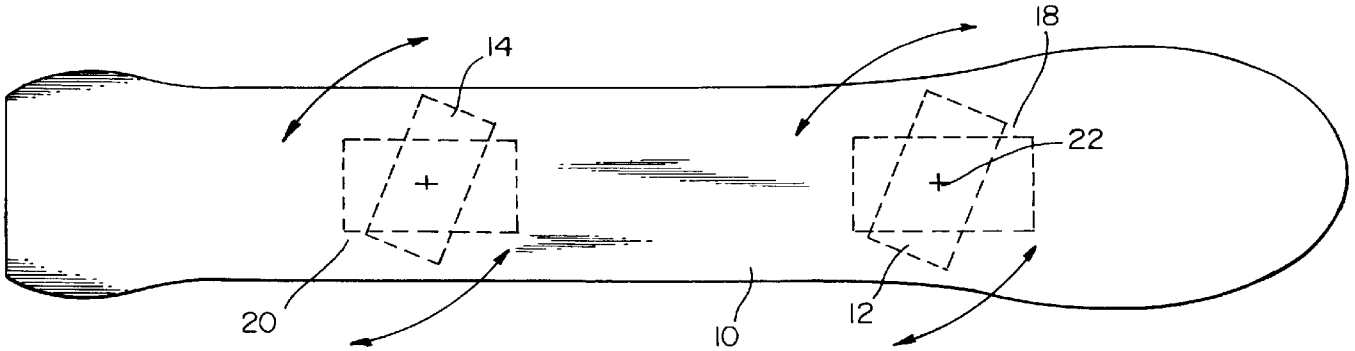
FIG. 2 is a top plan view of a snowboard showing in diagram form a plurality of rider foot positions on the snowboard.

FIG. 2 illustrates the basic concept of the invention. The snowboard 10 has a front foot station 18 and a rear foot station 20. In FIG. 2, the front and rear foot components 12, 14 are shown in the form of rectangular diagrams 12, 14. According to the invention, the front foot component 12 is suitably secured to the snowboard 10 for rotation in position about an axis 22. The front foot component 12 is rotatable azimuthally, at least from a position directed laterally to one side of the board, around the front end of the board, to a position directed laterally towards the opposite side of the board. The front foot component 12 is otherwise secured to the snowboard 10. The rear foot component 14 also has a plurality of azimuthally positions. However, it is mounted for a step-out release from the snowboard 10, as will be described. In FIG. 2, the front and rear foot mounts 12, 14 are shown in two of their several positions. They are shown oriented at a diagonal to the snowboard 10 which would be a typical riding position. In this position, the toes on the rider's feet would be directed towards the left side of the board. The second position is a straight ahead position. This is a position that might be assumed while riding the chair lift.

Figure 3:
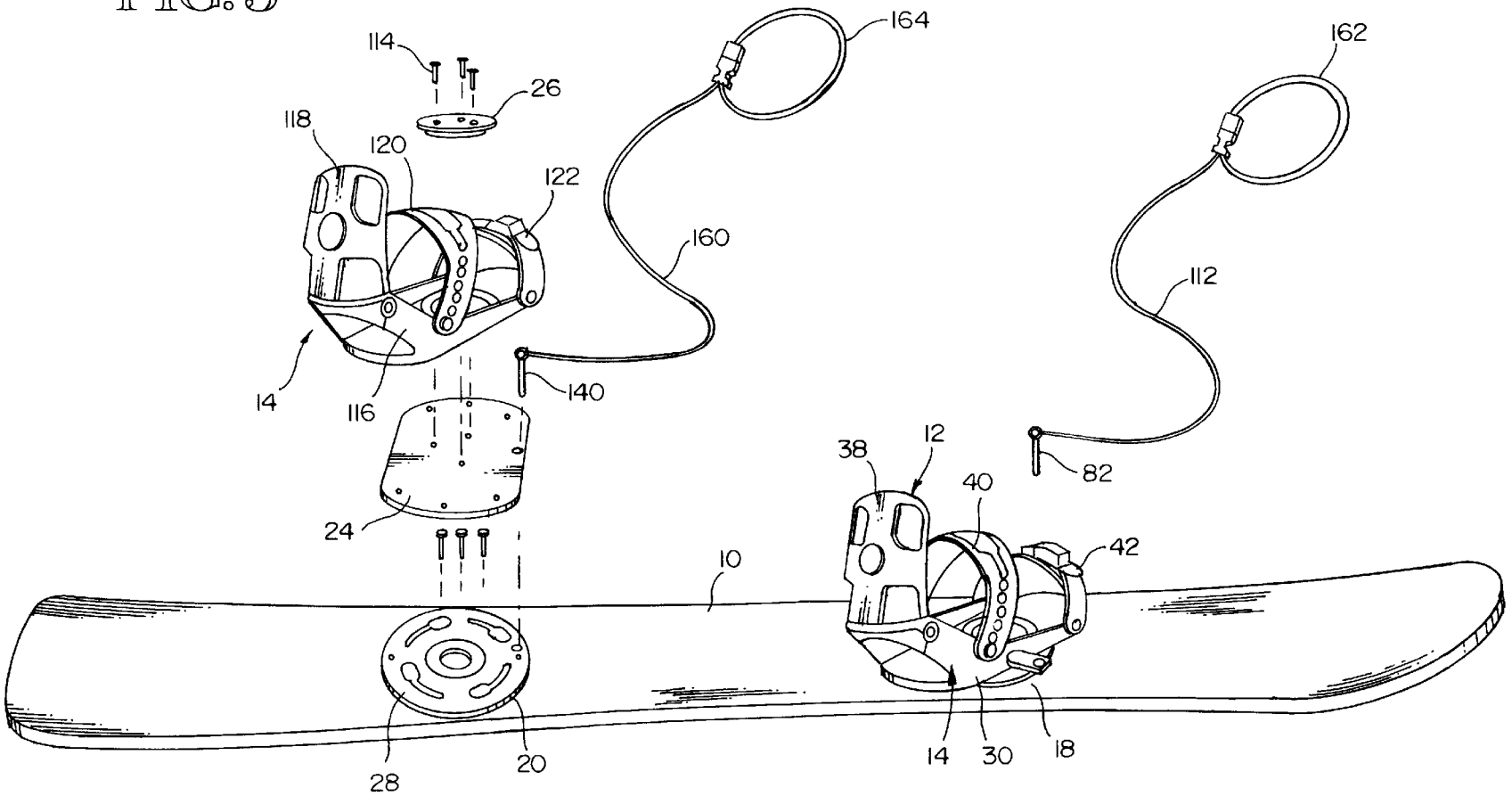
FIG. 3 is a view like FIG. 1, but presenting an exploded pictorial view of the rear foot mount and showing the front foot mount on the snowboard, with a lock pin component in spaced relationship to the location of its securement to the front foot mount.

Referring to FIG. 3, the rear foot mount 14 is shown separated from the snowboard 10. Bottom plate 24 is a part of the mount 14, as is member 26. In this embodiment, a mounting plate 28 is secured to the rear foot station 20 on the snowboard 10. The rear foot mount 14 will be hereinafter described in some detail, and partially by a reference to the aforementioned U.S. Pat. No. 5,354,088. This will be done following a description of the front foot mount 12, which is next.

In the preferred embodiment, the front foot mount 12 is a binding 14 for receiving a boot on the front foot of the snowboard rider. Binding 14 includes a base member 30 that is preferably formed of metal and has a planer bottom plate 32 (FIGS. 4 and 5) and generally upstanding sides 34, 36 to which a rear pad 38 and binding straps 40, 42 are secured. The bottom plate 32 is shaped to receive the bottom of the boot that is received within the binding 14. In the preferred embodiment, bottom plate 32 includes a circular center opening 44, best shown in FIG. 5. The bottom plate 32 is a part of the front foot mount 12 and moves with the front foot mount 12 relative to the snowboard 10, about the axis of rotation 22. Axis 22 may also be referred to as a pivot axis. This is because in use, the front foot mount 12 pivots in position about the axis 22. That is, it is correct to say either that the mount 12 rotates about the axis 22 or that it pivots about the axis 22.

Figure 4:
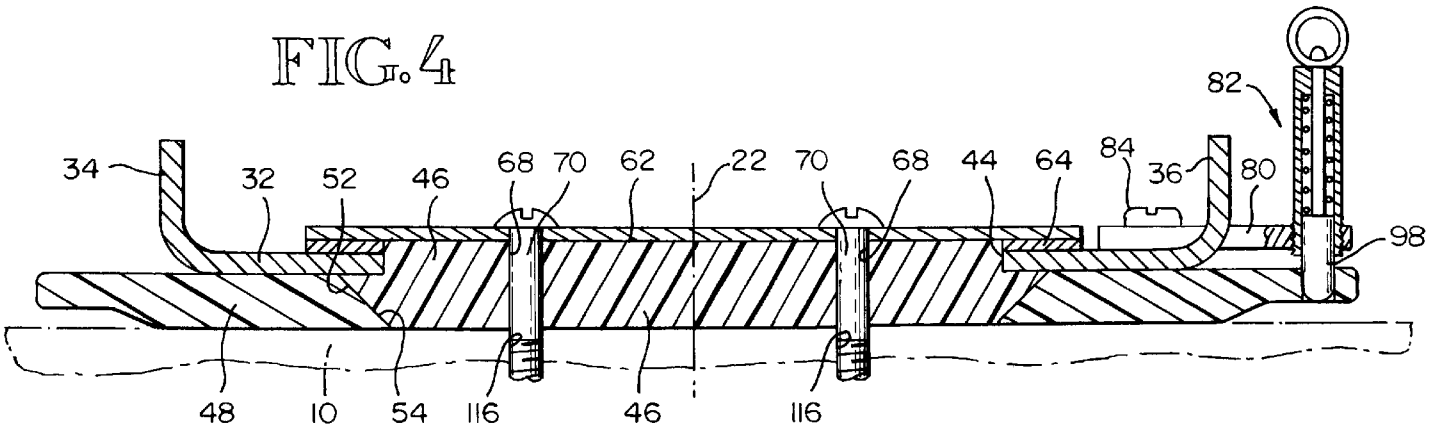
FIG. 4 is a cross sectional view through a preferred embodiment of a structure which secures the front foot mount to the snowboard for rider controlled rotation of the front foot relative to the snowboard, and for locking the front foot mount into one of a plurality of positions on the snowboard, selected by the rider.
Figure 13:
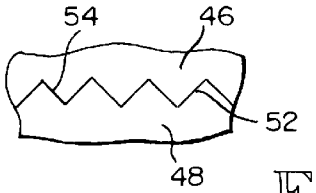
FIG. 13 is a bottom plan view taken substantially along the aspect of line 13—13 in FIG. 8, such view showing the mating of the serrations that lock the catch plate to a connector member.

In the preferred embodiment, the other structure at the front foot station includes a two-part board plate. The first part is a generally circular center part 46. The second part is an annular part that surrounds the first part 46. The annular part 48 includes a center opening 50 which receives the center part 46. Interlocking elements 52, 54 are formed on the peripheries of the center part 46 and the opening 50, respectively. These interlocking elements may be in the form of complementary serrations, viz. teeth and notches, as shown in FIG. 13. The center portion 46 has a base which includes the serrations 52 on its periphery. It also has an upper axle portion 56 with a cylindrical sidewall 58 that intersects a radial wall 60 on the base. The upper axle portion 56 has a diameter that is only slightly smaller than the diameter of opening 44. This two-part construction of the board plate provides for an azimuthal adjustment in position of the annular part 48, for reasons that will hereinafter be described. When the mounting structure is attached to the front foot station 18, the annular part 48 is first set into a desired position, then, the center part 46 is set down into the opening 50 (FIG. 4). Then, the binding frame 30 is set down with the axle portion 56 located within opening 44. Next, clamp plate 62 is set down on the bottom plate 32. Clamp plate 62 includes an annular bearing ring 64 of a slide bearing material at its lower periphery. This bearing ring 64 sits down on the bottom plate 32. Next, screw fasteners (e.g. four) are installed through openings 66, 68 in the clamp plate 62 and the center portion 46, respectively. These screw fasteners 70 are then threaded into threaded openings that are provided in the snowboard 10. As shown by FIG. 4, the fasteners 70 directly secure the clamp plate 62 and the center portion 46 of the board plate to the snowboard 10. The part of center portion 46 which fits into opening 50, and the opening 50, are tapered. As a result, when the center portion 46 is secured to the snowboard 10, it clamps the annular portion 48 to the snowboard 10. The mating serrations 52, 54 prevents the annular portion 48 from rotating in position relative to the center portion 46.

The board plate portions 46, 48 are preferably constructed from a suitable plastic material that functions as a slide bearing. Also, ring 64 is formed from the same material. When the parts are assembled, as shown in FIG. 4, the portion of bottom plate 32 that borders opening 44 is sandwiched between bearing ring 64 and surfaces 60, 72 of board plate portions 46, 48. Bottom plate 32 is trapped between the lower surface of bearing ring 64 and the surfaces 70, 62 but is not gripped by the surfaces. In fact, the space between the lower surface of bearing ring 64 and the surfaces 60, 72 is slightly larger than the thickness of bottom plate 32. This is so that plate 32 and the base 30 of which it is a part are free to rotate or pivot about the axis 22.

Figure 6:
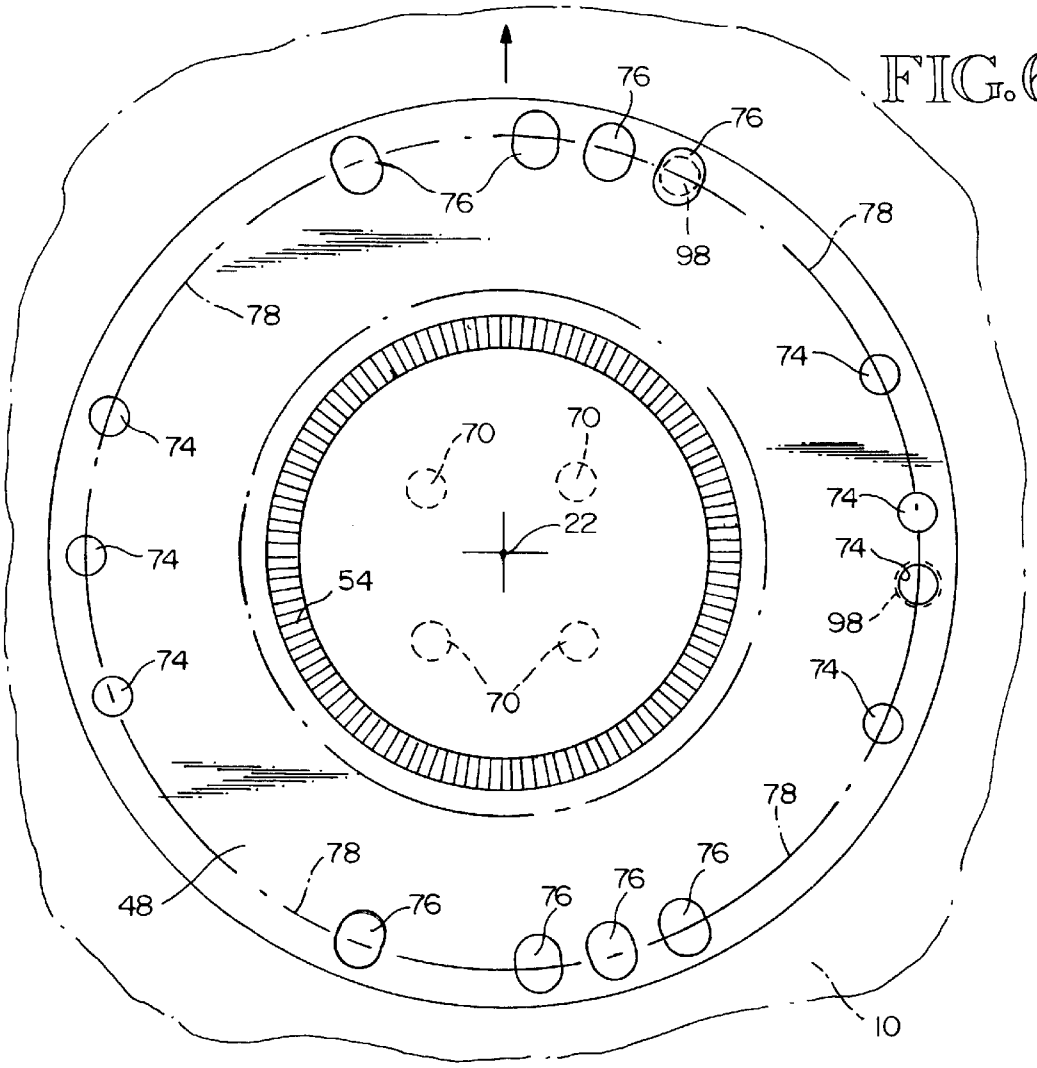
FIG. 6 is a top plan view of a catch plate component of the preferred embodiment of the front foot mount, such component including a plurality of lock pin catch openings which are spaced about the axis of front foot rotation.
Figure 8:
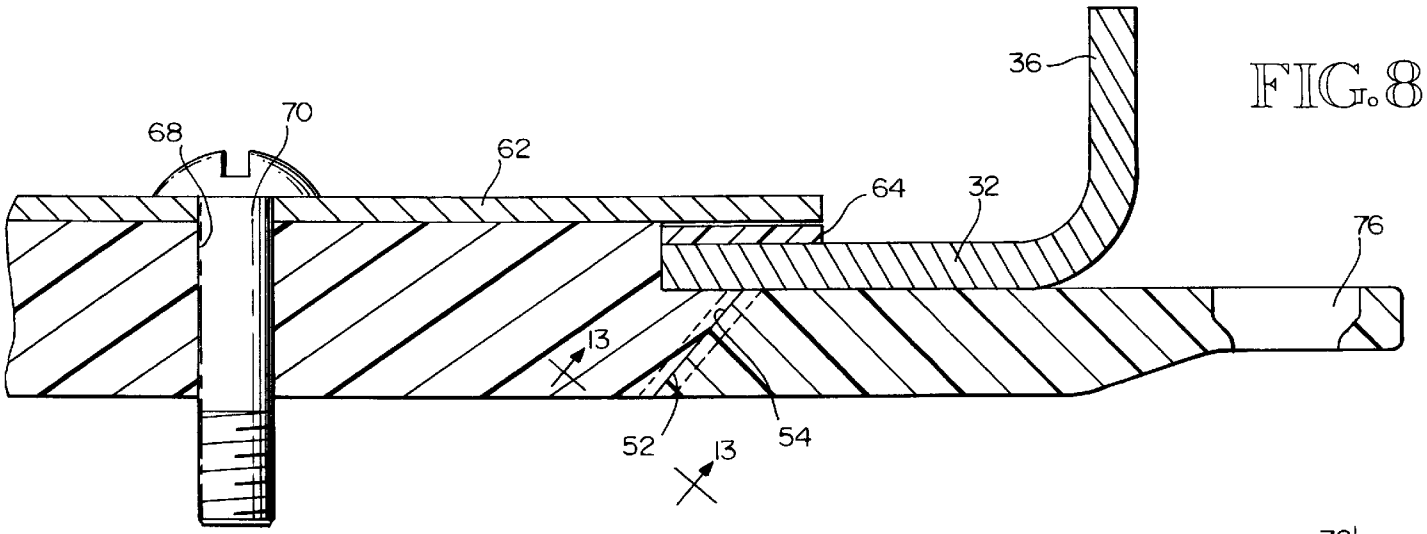
FIG. 8 is an enlarged scale sectional view of a portion of the mechanism shown by FIGS. 4 and 5.

The annular part 48 of the board plate may also be termed a "catch" plate. This is because it includes a plurality of "catches," which in the preferred embodiment are in the form of two types of openings that extend through the plate 48, parallel to axis 22. The first openings 74 are smaller than the second openings 76. This is for reasons that are described below. Referring to FIG. 6, the openings or "catches" 74, 76 are angularly spaced apart on a common circle 78. That is, the centers of the openings 74, 76 are on the circle 78.

Figure 5:
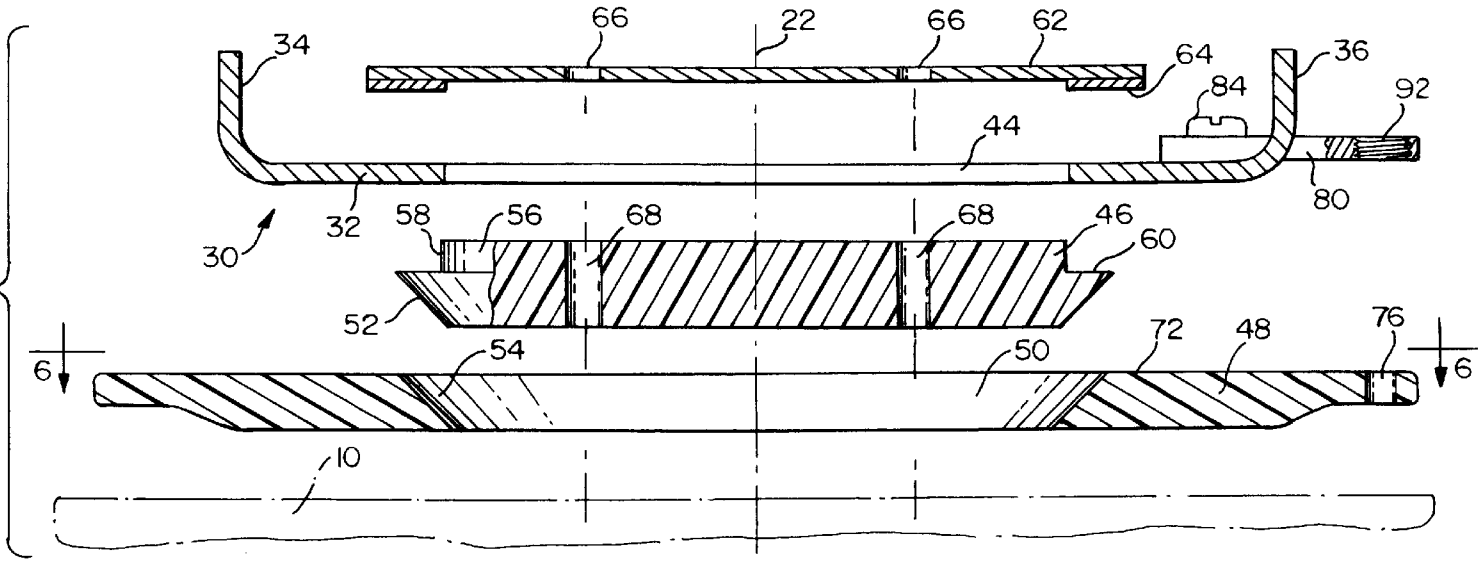
FIG. 5 is a view similar to FIG. 4 but showing the several components of the front foot mount spaced apart from each other and from the top of the snowboard.
Figure 7:
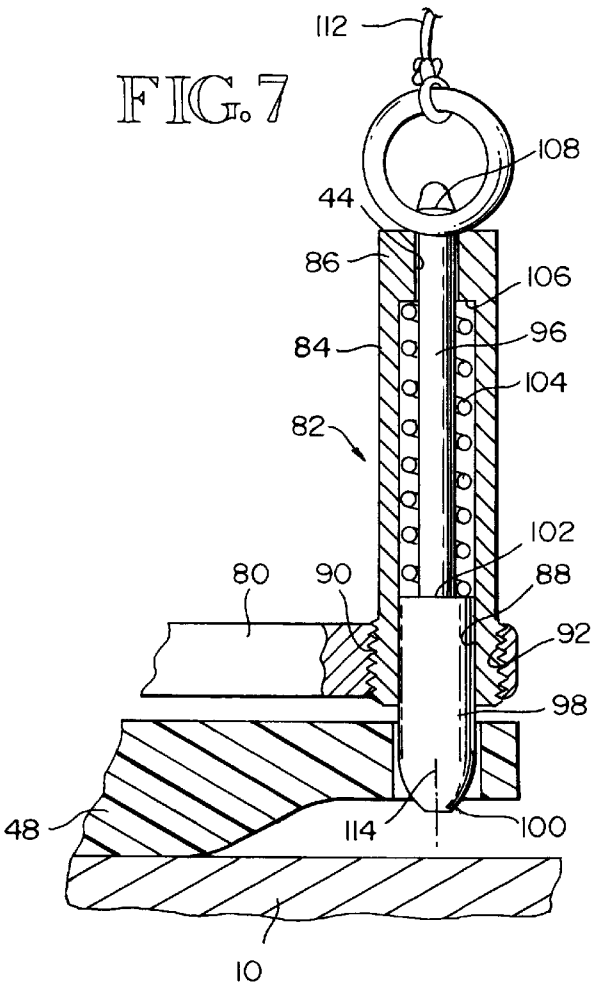
FIG. 7 is an enlarged scale detailed view of a lock pin shown in a "lock" position.

In the preferred embodiment, the binding base 30 includes a support arm 80 for a lock pin assembly 82. Support arm 80 has an inner end portion that is secured to the base 30, such as by a screw fastener 84, for example, (FIGS. 4 & 5). Referring to FIG. 7, the lock pin assembly 83 may include a tubular housing 84, having a closed upper end 86 and an open lower end 88. The lower end portion of housing 84 may be threaded at 90, so that it can be detachably secured to the arm 80. Arm 80 is shown to have a threaded opening 92 formed in its outer end portion. The closed end 86 of housing 84 includes a center opening 94 for receiving a narrow upper portion 96 of a lock pin 98. The lock pin 98 includes a rounded and somewhat tapered lower end portion 100. A shoulder 102 is formed between lock pin 98 and its upper portion 96. A compression spring 104 is positioned within the housing 82, around element 96, between shoulder 102 and a second upper shoulder 106. The lock pin member 96, 98 may be provided with a transverse opening 108 in the upper end part of upper portion 96. This opening 108 may be used to secure a ring 110 to the upper end of part 96.

The assembly of the lock pin assembly 82 will now be described. With ring 110 detached, the compression spring 107 is positioned on the lock pin part 96. Then, the lock pin part 96 and the spring 104 are inserted into the housing 84, through the open lower end 88. The lock pin is moved upwardly until the part 96 is sufficiently within opening 94 to allow the ring 110 to be attached. The ring 110 is placed on the upper end of part 96 through opening 108. When the assembly is complete, the spring 104 is compressed somewhat and its spring biases the lock pin 96 downwardly into the position shown by FIG. 7. The purpose of the ring 110 is to provide a way of attaching a pull line 112 to the lock pin 98. The lower end of the pull line 112 is tied or otherwise secured to the ring 110. As will be described, the pull line 112 is pulled upon for the purpose of pulling the lock pin 98 upwardly. As the lock pin 98 so moves, the compression spring 104 is compressed an additional amount.

Figure 12:
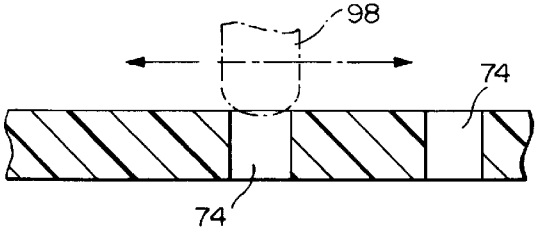
FIG. 12 is a fragmentary sectional view through a portion of the catch plate, showing the locked pin engaged in a catch opening in the catch plate, and further showing an adjacent catch opening.

The mounting arm 80 mounts the lock pin 98 in a position which places its center axis 114 on the circle 78. Arm 80, and the lock pin assembly 82, rotate with the binding base 30 as the binding base 30 rotates or pivots about axis 22. As shown by FIG. 12, the catch openings 74 are smaller in diameter than the lock pin 98. However, because the lower end of the lock pin 98 is rounded and somewhat tapered, a short lower end portion of the lock pin 98 can penetrate into each opening 74 as the lock pin 98 moves into registry with the opening 74. When this happens, the lock pin 98 is moved upwardly from the position shown in FIG. 7, and the spring 104 is compressed an amount greater than it is in the position shown by FIG. 7. The spring force holds the lock pin 98 into the opening 74 and this releasably locks the lock pin 98, and hence the binding base 30, to the plate 48. The "lock" so formed is in the nature of a detent lock. It allows the pin to be forced out from a given opening 74 by a sideways force being applied on the pin 98. The openings 76 have a diameter that is larger than the diameter of lock pin 98. As a result, when the lock pin 98 moves into alignment with an opening 76, the spring 104 forces the lock pin 98 down into a full engagement with the opening 76. That is, a longer end portion of lock pin 98 is positioned in the opening 76. When this occurs, the lock pin 98 cannot be disengaged from the opening 76 simply by applying a sideways force on the lock pin 98. It is necessary for the lock pin 98 to be pulled out from the opening 76 by use of line 112.

FIG. 6 includes a broken line showing of the lock pin 98 in one of the openings 74. This opening 74 is approximately at a 3 o'clock position on the circle 78. FIG. 6 also includes a second broken line showing of lock pin 98 within one of the openings 76. This opening is at about a 1 o'clock position on the circle 78. As shown by FIG. 6, there are a plurality of openings 74 on the circle 78 at what are side positions of member 48 relative to the snowboard 10. That is, the openings 74 are positioned adjacent the sides of the snowboard 10. The openings 76 are positioned between the sides, front and aft, as shown by FIG. 6. The support arm 80 is on one side of the binding base 30. As a result, the lock pin 98 is on one side of the binding base 30. As a result, when the front foot mount is generally aligned with the snowboard 10, the lock pin 98 is in the vicinity of one group of the openings 78. When the front foot mount is positioned towards one side or the other of the snowboard 10, the lock pin 98 is in the vicinity of a group of the openings 76. What this means, is that when the lock pin 98 is in the vicinity of a group of the smaller openings 74, the front foot mount can be shifted in position, from one opening 74 to the next, in both directions, by the rider merely rotating or pivoting his/her front foot in position on the board 10. This rotation or pivotal movement of the front foot moves the lock pin 98 along the circle 78. The force applied by the foot causes the lock pin 98 to be cammed out from an opening 74, into a position on top of the member 48. As the front foot is moved an additional amount, the lock pin 98 moves onto the next opening 74. It is "stepped" from each opening 74 onto the next opening 74 until the snowboard rider stops the rotation or pivotable movement of his/her front foot. If the lock pin 98 is in the vicinity of a group of openings 76, it and the front foot mount of which it is a part can be moved by rider foot movement but only until the lock pin 98 moves into an opening 76. When this happens, there can be no further rotation or pivotal movement of the front foot mount about the axis 22 until the lock pin 98 is moved out from the opening 76, by the snowboard rider applying a pulling force on the pull line 112. Thus, once the rider sets the front foot mount into a "ride" position, the front foot mount will stay into that mount until the lock pin 98 is pulled out from a particular opening 76 that was selected by the rider.

The purpose of the two-part construction of bottom plate 46, 48 will now be described. Referring to FIG. 6, the two part construction allows the board plate to be secured to the snowboard 10 by the same set of fastener holes 116, while at the same time providing a way of adjusting the angular or azimuthal positioning of the openings 74, 76. Referring to FIG. 6, the annular member 48 can be rotated to place the openings 74, 76 in a desired position relative to the snowboard 10. Then, the center member 46 can be inserted into the center opening 50 in annular member 48. It can be so inserted with the opening 68 in it aligned with fastener receiving openings 116 in the snowboard 10. Then, the center part 46 can be dropped into place, with its serrations 52 mating with the serrations 54 formed around the periphery of opening 50. Then, the front mount base 30, the clamp plate 62 and the screw fastener 70 can be assembled, in the manner previously described. This firmly secures the member 48 to the snowboard 10. At a later time, if desired, the assembly can be disassembled and the annular member 48 can be repositioned, followed by the parts 30, 46, 62, 70 being reassembled and attached to the snowboard pin 10.

Figure 9:
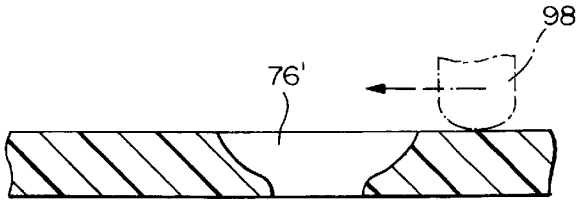
FIGS. 9–11 show three variations of the lock pin receiving catch openings.
Figure 10:
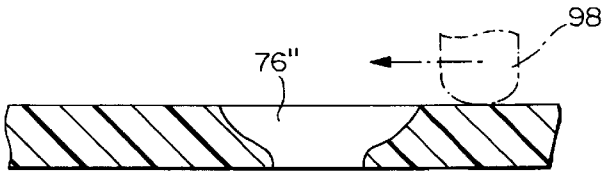
Figure 11:
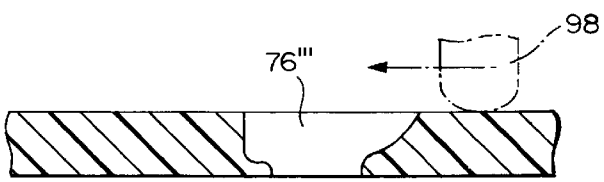

As shown in FIG. 6, the openings 76 may have an oval shape when viewed from the top. They are shown to be wider in the radial direction than they are in the circumferential direction. FIGS. 9–11 show variations in the cross sectional profile of the opening 76, taken in a radial plane. FIG. 9 shows a steep angle at both the entry and exit sides of the hole 76'. FIG. 10 shows a shallow angle on the entry side and a steep angle on the exit side of the hole 76". FIG. 11 shows a shallow angle on the entry side and a stop wall shape on the exit side of the hole 76'''. These figures show that the hole shape of hole 76 is a variable.

Figure 14:
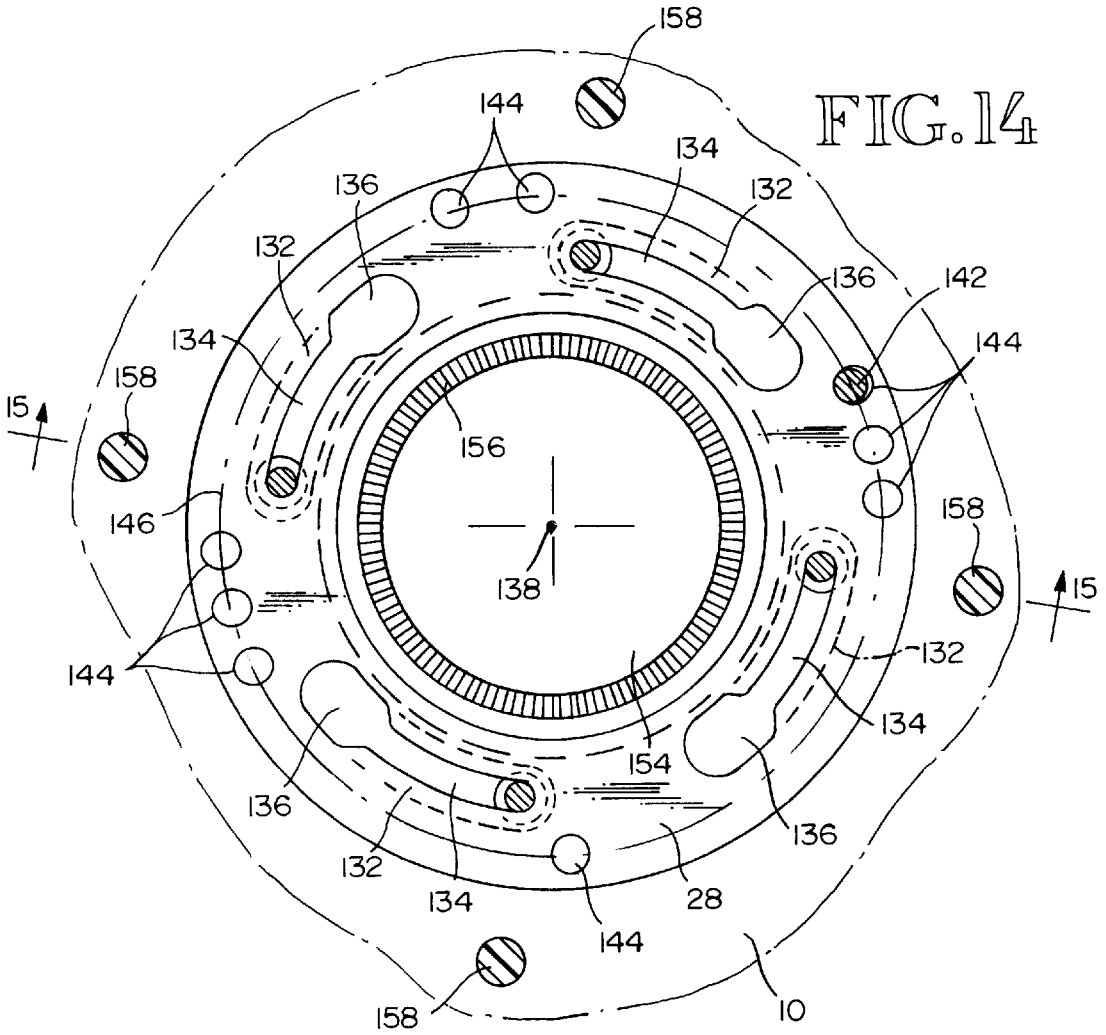
FIG. 14 is a sectional view taken substantially along line 14—14 of FIG. 15, with the connector member omitted, such view showing the lock pin down in a catch opening.
Figure 15:
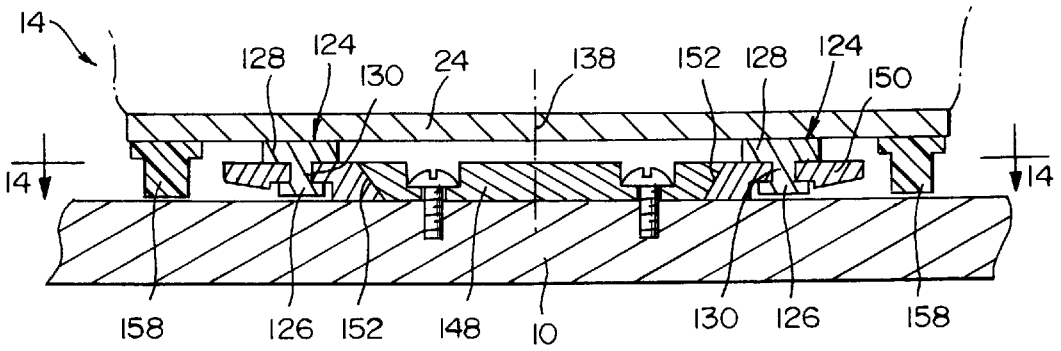
FIG. 15 is a sectional view taken substantially along line 15—15 of FIG. 14, such view including the connector member and showing two of the fasteners used to connect the connector member to the snowboard.

Referring to FIGS. 3, 14 and 15, the rear foot mount 14 is basically like the rear foot mount that is disclosed in the aforementioned U.S. Pat. No. 5,354,088. As previously described, it includes a mounting plate 28 that is secured to the snowboard 10 and a bottom plate 24 that is a part of the rear mount 24. As shown by FIG. 3, bottom plate 24 is a planer member that is attached to the rear foot mount 14 by a member 26 and fasteners 114. The rear foot mount 14 has a base frame 116 that may be very similar to base frame 30 of front foot mount 12. This base frame 116 has a flat bottom wall or plate and upstanding side portions to which a heel rest 118 and binding straps 120, 122 are secured. The bottom plate 24 is placed below the bottom of the binding frame 116. Member 26 is brought down from above and partially inserted through an opening in the bottom of the binding frame 116. A flange at the periphery of member 26 sets down onto a mating flange that surrounds the opening in the bottom plate of binding frame 116. Then, the fasteners 114 are inserted through openings in member 26, and into threaded openings in the bottom plate 24. This secures bottom plate 24 to the bottom of the binding frame 116. As shown by FIG. 15, and in U.S. Pat. No. 5,354,088, four connectors 124 depend downwardly from bottom plate 24. Each connector 124 includes a lower portion 126, and upper portion 128 and a center portion 130. The plate 28 secured to snowboard 10 is shown in FIG. 14 to have four circumferentially spaced apart arcuate segments 132. Each arcuate segment 132 is formed to include an elongated arcuate slot 134 and an enlarged end portion 136. Or, each arcuate slot 134 may have two enlarged end portions, one at each end as disclosed in U.S. Pat. No. 5,354,088. The enlarged portion 136 of the slots 134 are sized to receive the lower portions 126 of the connectors 124. The center portion 130 of the connectors 124 are of a width allowing them to fit within the narrow portions of the slots 134. The lower portions 126 and the upper portions 128 of the connectors 124 are wider than the slots, as shown by FIG. 15. In use, the rider orients his/her foot to place the connector member portions 126 into alignment with the enlarged portions 126 of the arcuate slots 134. Then, the rider steps down and pivots his/her foot about axis 138, in the direction of the slots 134. This causes the center portions 130 of the connectors 124 to enter into the slots 134, and further causes the lower portions 126 of the connectors 124 to slide under the portions of plate 28 that immediately border the sides of the slots 124. The plate 24 carries with it a lock pin assembly 140 that is like lock pin assembly 82. See also lock pin assembly 50 in U.S. Pat. No. 5,354,088. As the rider's foot is rotated, to move the connector portions 130 through the arcuate slots 134, the lock pin 142 (FIG. 14) is moved into a catch in the plate 28 that may be in the form of an opening in the plate 28 that extends through the plate 28, parallel to axis 138. FIG. 14 shows the plate 28 including a plurality of catch openings 144, spaced circumferentially about the plate 28, on a common circle 146. Of course, the number and spacing of the openings or catches 144 may vary. Also, the plate 26 may be constructed in two parts, like the board plate 46, 48. The parts may be a generally circular inner part 148 and annular outer part 150. The outer part may include a tapered opening and the inner part may include a complementary tapered periphery, provided with complementary serrations, as described above in connection with plate 46, 48. This allows the outer portion 140 to be adjusted in position in the same manner as the outer portion 48 of plate 46, 48. In FIG. 15, the mating serrations are shown at location 152. The serrations at the periphery of the opening 154 are designated 156 in FIG. 14.

The four slot segments 132 provide four different entry positions of the connector members 126, each with a different orientation of the rider's rear foot relative to the snowboard 10. The number and placement of the openings 144 provide a choice of positions within slots 132.

In the preferred embodiment, bottom plate 24 is provided with a plurality of slide bearings 158, depending from plate 24 and spaced outwardly from the connectors 124. The slide bearings 158 are made from a suitable bearing material. They are positioned to contact and slide upon the upper surface of the snowboard 10 during rotation of the rear foot component 14, during its connection or disconnection from the plate 28. The slide bearings 158 also provide lateral support when the rear foot component 14 is engaged and provide traction when the rear foot is being used to push the rider. The lock pin 140 is provided with a pull line 160, which may be like pull line 112. The pull lines 112, 160 may include loops 162, 164 at their upper ends which are securable about the legs of the rider, above the rider's knees. This positions the lift lines 112, 160 into positions for easy grasp by the rider.

The front and rear foot mounts 12, 14 of this invention allows a rider to make a step-in connection of his/her rear foot with the snowboard at a number of different azimuthal positions, selected by the rider. It also allows a quick disconnect of the rear foot from snowboard 10. Furthermore, it allows a rotational movement of the front foot on the board, amongst a large number of azimuthal positions. The use of the two mounts together provides maximum convenience to the rider, when riding the board down a slope, when propelling the board by foot action, and when mounting, riding and dismounting a chair on a chair lift.

The illustrated embodiments are only examples of the snowboard foot mounts of the present invention and, therefore, are non-limitive. It to be understood than many changes in the particular structure, materials and features of the mounts may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents.

What is claimed is:

1. A snowboard, comprising:

a front foot component to which in use the front foot of a snowboard rider is secured;

a front foot station on the snowboard to which the front foot component is secured, for rotation about an axis, in response to a rotation by the rider of his/her front foot and the front foot component, relative to the snowboard;

a releasable lock for locking the front foot component into a plurality of rider-selected positions on the snowboard;

wherein the lock includes a plurality of catches at the front foot station, spaced about said axis, and a lock pin carried by the front foot component that is selectable engageable in said catches, for locking the front foot component in a rider-selected position on the snowboard;

wherein the lock pin is spring biased towards and into a said catch as said pin moves into registry with the catch in response to said rotation by the rider of his/her front foot and the front foot component in position on the snowboard; and wherein at least one of the catches engages a short end portion of the spring biased lock pin so that the lock pin functions as a detent and is movable into and out from such catch by rider rotation of his/her front foot and the front foot component in position of the snowboard.

2. The snowboard of claim 1, wherein at least one other of the catches is sized to engage a shorter end portion of the spring biased lock pin so that the lock pin functions as a detent that is movable into and out from such catch by rider rotation of his/her front foot and the front foot component on the snowboard.

3. A snowboard, comprising:

a front foot component to which in use the front foot of a snowboard rider is secured;

a front foot station on the snowboard to which the front foot component is secured, for rotation about an axis, in response to a rotation by the rider of his/her front foot and the front foot component, relative to the snowboard;

a releasable lock for locking the front foot component into a plurality of rider-selected positions on the snowboard;

wherein the lock includes a plurality of first catches at the front foot station, spaced about said axis, a plurality of second catches at the front foot station, also spaced about said axis, and a lock pin carried by the front foot component that is selectively engageable with said catches, for locking the front foot component in a rider-selected position on the snowboard, wherein the lock pin is spring biased towards and into a said catch as said lock pin moves into registry with the catch, in response to rotation by the rider of his/her front foot and the front foot component, on the snowboard, and wherein the first said catches engage a shorter end portion of the spring biased lock pin so the lock pin functions as a detent that is movable into and out from each said first catch by rider rotation of his/her front foot and the front foot component; and wherein the second catches are sized to receive a longer end portion of the lock pin and hold it against sideways movement until it is withdrawn from the catch by the rider.

4. The snowboard of claim 3, wherein said lock pin includes a pull line that in use is secured to the lock pin and extends upwardly into a position to be grasped by the rider, so that the pull line can be pulled upon by the rider to pull the lock pin out of engagement with said second catch.

5. A snowboard, comprising:

a front foot component to which in use the front foot of a snowboard rider is secured;

a front foot station on the snowboard to which the front foot component is secured, for rotation about an axis, in response to a rotation by the rider of his/her front foot and the front foot component, relative to the snowboard;

a releasable lock for locking the front foot component into a plurality of rider-selected positions on the snowboard;

a rear foot component to which in use the rear foot of the snowboard rider is secured, a rear foot station on the snowboard to which the rear foot component is detachably connected by a step-in mount for the rear foot component that includes a rider controlled, releasable lock that locks the rear foot component to the snowboard, said lock including a lock release to release the lock and allow the rider to with his/her rear foot step away from the snowboard;

wherein the lock for the front foot component includes a plurality of catches at the front station, spaced about said axis, a lock element carried by the front foot component that is selectably engageable in said catches, for locking the front foot component in a rider-selected position on the snowboard;

wherein the lock pin is a pin that is spring biased towards and into a said catch as said pin moves into registry with the catch in response to said rotation by the rider of his/her front foot and the front foot component on the snowboard; and wherein at least one of the catches engages a short end portion of the spring biased lock pin so that the lock pin functions as a detent and is movable into and out from such catch by rider rotation of his/her front foot and the front component of his/her front foot and the front foot component.

6. The snowboard of claim 5, wherein at least one of the catches is sized to receive a longer end portion of the lock pin and hold it in said catch until the lock pin is withdrawn from the catch by the rider, and wherein said lock pin includes a pull line that in use is secured to the lock pin and extends upwardly into a position to be grasped by the rider, so that the pull line can be pulled upon to pull the lock pin out of engagement with said catch.

7. The snowboard of claim 6, wherein at least one other of the catches is sized to engage a shorter end portion of the spring biased lock pin so that the lock pin functions as a detent that is movable into and out from such catch by rider rotation of his/her front foot and the front foot component.

8. A snowboard, comprising:

a front foot component to which in use the front foot of a snowboard rider is secured;

a front foot station on the snowboard to which the front foot component is secured, for rotation about an axis, in response to a rotation by the rider of his/her front foot and the front foot component, relative to the snowboard;

a releasable lock for locking the front foot component into a plurality of rider-selected positions on the snowboard;

a rear foot component to which in use the rear foot of the snowboard rider is secured, a rear foot station on the snowboard to which the rear foot component is detachably connected by a step-in mount for the rear foot component that includes a rider controlled, releasable lock that locks the rear foot component to the snowboard, said lock including a lock release to release operable by the rider to release the lock and allow the rider to with his/her rear foot step away from the snowboard;

wherein the lock for the front foot component includes a plurality of first catches at the front foot station, spaced about said axis, a plurality of second catches at the front foot station, also spaced about said axis, and a lock pin carried by the front foot component that is selectively engageable with said catches, for locking the front foot component in a rider-selected position on the snowboard, wherein the lock pin is spring biased towards and into a said catch as said lock pin moves into registry with the catch, in response to rotation by the rider of his/her front foot and the front foot component in position on the snowboard;

wherein the first said catches engage a shorter end portion of the spring biased lock pin so the lock pin functions as a detent that is movable into and out from each said first catch by rider rotation by the rider of his/her front foot and the front foot component in position on the snowboard;

wherein the first said catches engage a shorter end portion of the spring biased lock pin so the lock pin functions as a detent that is movable into and out from each said first catch by rider rotation of his/her front foot and the front foot component; and wherein the second catches are sized to receive a longer end portion of the lock pin and hold it against movement until it is withdrawn from the catch by the rider.

9. The snowboard of claim 8, wherein said lock pin includes a pull line that in use is secured to the lock pin and extends upwardly into a position to be grasped by the rider, so that the pull line can be pulled upon by the rider to pull the lock pin out of engagement with a said second catch.

10. A snowboard, comprising:

a front foot component to which in use the front foot of a snowboard rider is secured;

a front foot station on the snowboard to which the front foot component is secured, for rotation about an axis, for azimuthal adjustment in position relative to the snowboard, in response to a rotation by the rider of his/her front foot and the front foot component, relative to the snowboard;

a releasable lock for locking the front foot component into a plurality of rider-selected positions on the snowboard;

wherein the lock includes a plurality of catches at the front foot station, spaced about said axis, and a lock pin carried by the front foot component that is selectively engageable in said catches, for locking the front foot component in a rider-selected azimuthal position on the snowboard;

wherein the lock pin is spring biased towards and into a catch as said pin moves into registry with the catch in response to said rotation by the rider of his/her front foot and the front foot component in position on the snowboard; and wherein said catches each engage a short end portion of the spring biased lock pin so that the lock pin functions as a detent and is movable into and out from such catch by rider rotation of his/her front foot and the front foot component in position on the snowboard.

11. The snowboard of claim 10, comprising a catch plate at the front foot station, said catch plate having a center portion and an annular portion surrounding the center portion, said center portion being secured to the snowboard and said annular portion being adjustably affixable in position relative to the center portion, said annular portion including said plurality of catches.

12. The snowboard of claim 11, wherein said annular portion of the catch plate also includes said plurality of other catches.

13. The snowboard of claim 10, further including a plurality of other catches spaced about said axis, said other catches being sized to receive a longer end portion of the lock pin and hold it against sideways movement until the lock pin is withdrawn from such catch by the rider.

14. A snowboard, comprising:

a foot component to which in use the foot of a snowboard rider is secured;

a foot station on the snowboard to which the foot component is secured, for rotation about an axis, in response to a rotation by the rider of his/her foot and the foot component, relative to the snowboard;

a catch plate at the foot station that is secured to the snowboard, said catch plate including an upstanding axle and a plurality of catches spaced about said axle radially outwardly from the axle;

a bottom plate at the foot station including a circular opening;

said axle extending upwardly into said circular opening;

said catch plate including a bearing surface below at least a portion of said bottom plate, radially outwardly from the axle, on which the bottom plate is supported for rotation;

a clamp plate positioned over said axle and an adjoining portion of the bottom plate of the foot component;

fastener elements connecting the clamp plate and the catch plate and the snowboard;

said clamp plate preventing movement of the catch plate and the foot component away from the snowboard; and a lock pin carried by the foot component, said lock pin being selectively engageable in said catches, for locking the foot component in a rider-selected position on the snowboard.

15. The snowboard of claim 14, wherein the catch plate comprises a central portion that is secured to the snowboard by the fastener elements and an annular portion that surrounds the central portion and includes at least a part of the bearing surface, said central portion of the catch plate including the upstanding axle, and said annular portion of the catch plate being adjustably affixable in position relative to the center portion of the catch plate.

16. The snowboard of claim 15, comprising complementary interlocking elements on said center portion and said annular portion for connecting said portions together, and allowing the annular portion to be placed at a selected azimuthal position on the snowboard, followed by a placement of the center portion inside said annular portion, placement of the clamp plate over the axle and an adjoining portion of the bottom plate, and a connection of the clamp plate and the center portion of the catch plate to the snowboard.

17. The snowboard of claim 16, wherein the central portion of the catch plate includes a portion of the bearing surface, such portion immediately surrounding the axle.

18. The snowboard of claim 17, wherein a ring of bearing material is positioned vertically between a peripheral portion of the clamp plate and a portion of the bottom plate that immediately surrounds the axle.

19. The snowboard of claim 18, wherein the lock pin is spring biased towards and into a said catch as said pin moves into registry with the catch in response to said rotation by the rider of his/her foot and the foot component in position on the snowboard, and wherein at least one of the catches engages a short end portion of the spring biased lock pin so that the lock pin functions as a detent and is movable into and out from such catch by rider rotation of his/her foot and the foot component in position on the snowboard.

20. The snowboard of claim 19, wherein at least one of the catches is sized to receive a longer end portion of the lock pin and hold it against sideways movement until it is withdrawn from the catch by the rider.

21. The snowboard of claim 19, wherein the foot component is a front foot component and the foot station on the snowboard is a front foot station, and wherein said snowboard further includes a rear foot component to which in use the rear foot of the snowboard rider is secured, a rear foot station on the snowboard to which the rear foot component is detachably connected by a step-in mount that includes a rider controlled, releasable lock that locks the rear foot component to the snowboard, said lock including a lock release that is operated by the rider to release the lock and allow the rider to with his/her rear foot step away from the snowboard.

22. The snowboard of claim 14, wherein a ring of bearing material is positioned vertically between a peripheral portion of the clamp plate and a portion of the bottom plate that immediately surrounds the axle.

23. The snowboard of claim 14, wherein the foot component is a front foot component and the foot station on the snowboard is a front foot station, and wherein said snowboard further includes a rear foot component to which in use the rear foot of the snowboard rider is secured, a rear foot station on the snowboard to which the rear foot component is detachably connected by a step-in mount that includes a rider controlled, releasable lock that locks the rear foot component to the snowboard, said lock including a lock release that is operated by the rider to release the lock and allow the rider to with his/her rear foot step away from the snowboard.

* * * * *